US006952935B2

(12) United States Patent
Vorosmarti et al.

(10) Patent No.: US 6,952,935 B2
(45) Date of Patent: Oct. 11, 2005

(54) ICE MAKING AND DELIVERY SYSTEM

(75) Inventors: James Vorosmarti, Center Valley, PA (US); James Frantz, Nazareth, PA (US)

(73) Assignee: Follett Corporation, Easton, PA (US)

( * ) Notice: Subject to any disclaimer, the term of this patent is extended or adjusted under 35 U.S.C. 154(b) by 0 days.

(21) Appl. No.: 10/715,935

(22) Filed: Nov. 18, 2003

(65) Prior Publication Data

US 2005/0103039 A1 May 19, 2005

(51) Int. Cl.[7] ..... F25C 5/18
(52) U.S. Cl. ..... 62/344; 62/354
(58) Field of Search ..... 62/298, 344, 354, 62/DIG. 2

(56) References Cited

U.S. PATENT DOCUMENTS 3,371,505 A * 3/1968 Raver et al. ..... 62/320
3,501,927 A * 3/1970 Wadsack ..... 62/320
4,276,751 A * 7/1981 Saltzman et al. ..... 62/138
4,328,681 A * 5/1982 Sakamoto et al. ..... 62/157
4,922,724 A * 5/1990 Grayson et al. ..... 62/135
6,581,392 B1 6/2003 Gist et al. ..... 62/66
6,637,227 B2 10/2003 Stensrud et al. ..... 62/217
6,668,575 B2 12/2003 Stensrud et al. ..... 62/298
6,691,528 B2 * 2/2004 Stensrud et al. ..... 62/344
6,705,107 B2 * 3/2004 Schlosser et al. ..... 62/344
6,711,910 B2 3/2004 Ziolkowski et al. ..... 62/196.4
2004/0093888 A1 * 5/2004 Willamor et al. ..... 62/344

* cited by examiner

*Primary Examiner*—William E. Tapolcai
(74) *Attorney, Agent, or Firm*—Paul & Paul

(57) ABSTRACT

An ice making and ice delivery system is provided, whereby nuggets of ice are formed from scraped ice in the ice making apparatus, which is cooled by an evaporator in a refrigeration cycle, with the evaporator being provided with refrigerant from a closed circuit compressor/condenser refrigerant system, with the evaporator and its associated ice making apparatus being capable of being disposed at a location remote from the condenser unit, for delivery of ice from one or more such evaporator/ice making apparatus to one or more ice storage units, which units can likewise be located spaced apart form the evaporator/ice making units, and with one or more ice delivery conduits providing for delivery of ice from the ice making unit(s) to the storage unit(s) by means other than gravity.

4 Claims, 1 Drawing Sheet

ICE MAKING AND DELIVERY SYSTEM

BACKGROUND OF THE INVENTION

Figure 1:
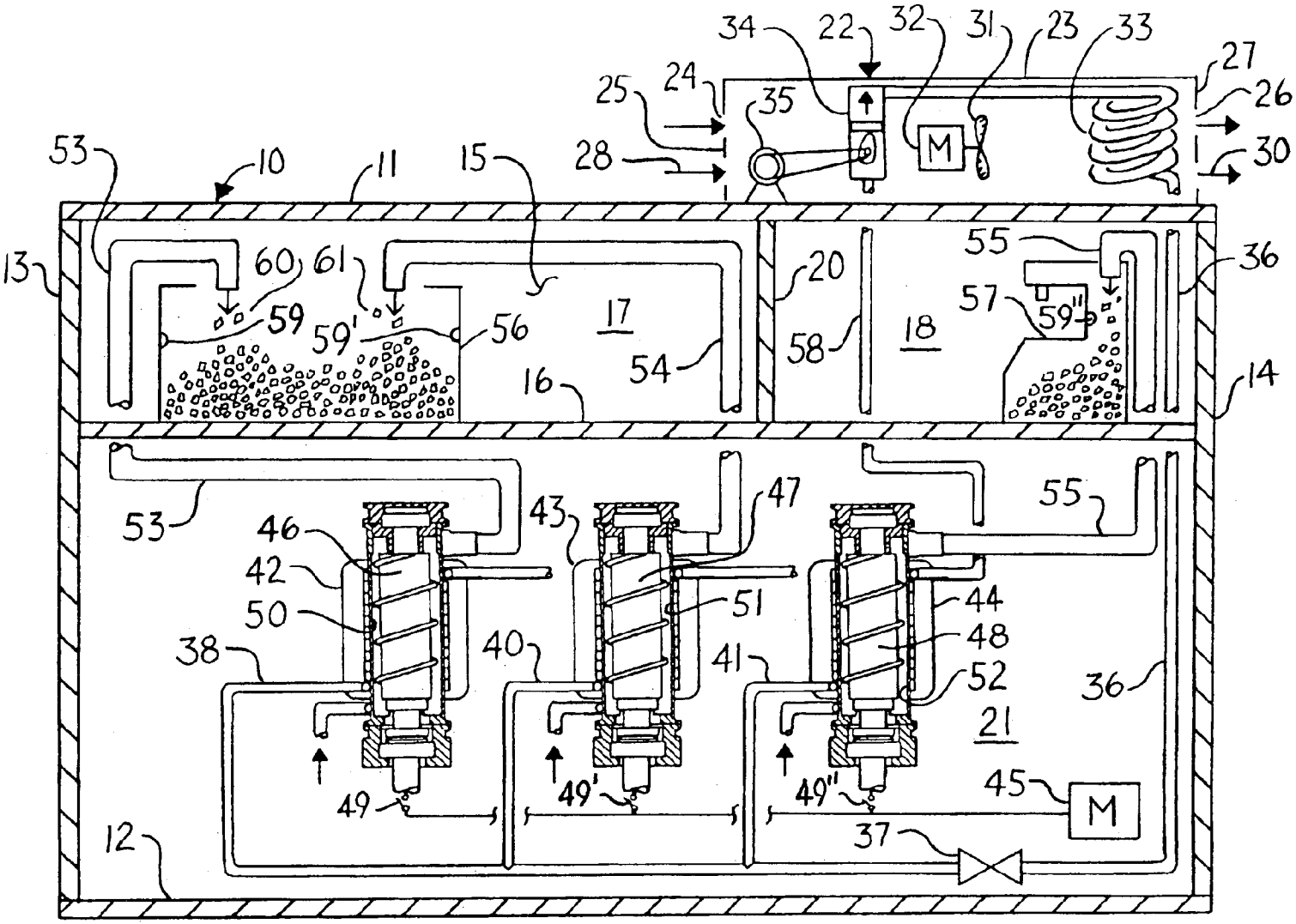

In the art of ice making, it is known that a refrigeration system is generally used to produce ice, which system includes a condenser unit, an expansion valve and an evaporator, with appropriate connections, such that the system operates as a closed loop.

Generally, an ice making apparatus is associated with the evaporator.

The condenser unit generally employs a compressor, a condenser, and a fan or other means for helping to dissipate heat from the condenser.

The evaporator often is used to make ice in the form of frozen cubes or other shapes from water that is deposited into trays or other cavities and then frozen due to the cooling effect provided by the evaporator.

In many such systems, when it is desired to evacuate the ice cubes or other shapes from their trays or other pockets of formation, heat is applied usually in the form of a hot gas, often from the condenser unit. In such systems, the formation of ice cubes or other shapes followed by the periodic application of heat to empty the pockets of ice cubes or other shapes results in the formation of the ice in batches, such that, after the ice is delivered from the pockets, the pockets are again filled with water, for freezing of the same by the evaporator. Such batch systems operate therefore, in an ice harvest cyclic manner. Examples of such systems may include U.S. Pat. Nos. 6,196,007; 6,134,907; 5,953,925 and/or 5,787,723.

In many such systems, the condenser unit is located immediate adjacent to, (or close to) the evaporator unit, for ready availability for allowing heat form the condenser to facilitate removal of ice cubes or other shapes from the ice-forming pockets.

Also, in many prior art units, the ice making apparatus is mounted above the ice storage unit for gravity delivery of ice into the storage unit, generally periodically or in a cyclic manner as described above, or requires the use of supplemental equipment, such as blower/vacuum systems that do not make ice but transport ice to remote storage locations in batches, after the ice is made in batches. Other systems, like U.S. Pat. No. 6,540,067 describe ice making, but their condensing unit is not separated from the ice making unit.

SUMMARY OF INVENTION

The present invention is directed to the continuous generation of ice nuggets from ice that is formed in an ice making apparatus that is continuously cooled by an associated evaporator whereby scraped ice is formed into nuggets and delivered to a storage unit.

A plurality of evaporators and their associated ice making apparatus may be used to continuously deliver ice to the same storage unit, for enhanced distribution of ice within the unit, or for delivery of ice to separate storage units, as may be desired.

The present invention also spaces the condenser unit apart from the evaporator/ice making apparatus, and preferably outside the building in which the ice making apparatus is located, such that compressor noise and condenser heat dissipation may occur outside the building in which ice is being made and in which personnel are working and/or accessing ice.

The present invention delivers ice from the ice making apparatus via a conduit that does not rely upon a blower/vacuum system or gravity feed a batch delivery of ice into the storage unit(s) and allows for placement of the ice storage unit(s) at location(s) located spaced apart from the evaporator/ice making unit, and spaced apart from condenser unit, as well.

Accordingly, it is a primary object of this invention to provide an ice making and delivery system for continuous production and delivery of ice to one or more storage units.

It is another object of this invention to have the condenser unit located spaced from or remote from the evaporator/ice making apparatus and from the ice storage unit.

It is a further object of this invention to accomplish the above objects wherein more than one evaporator/ice storage unit may be used to make ice nuggets, for delivery to different ice storage units, or to different locations within a given ice storage unit, but wherein the ice storage unit(s) are located spaced away from the evaporator/ice making apparatus.

It is another object of this invention to accomplish the above objects, wherein ice nuggets are delivered from the ice making apparatus to one or more storage units, via an integral driving means other than gravity, as distinguished from a separate blower/vacuum system.

Other objects and advantages of the present invention will be readily apparent from a reading of the following brief description of the drawing figure, the detailed descriptions of the preferred embodiments, and the appended claims.

DETAIL DESCRIPTION OF THE DRAWING FIGURE

FIG. 1 is a schematic illustration of a vertical sectional view taken through a building, in which the ice making and delivery system of the present invention is used, with a plurality of evaporator/ice making apparatus being provided with refrigerant via a condenser unit and returning the refrigerant thereto, and with the ice making apparatus shown at a location remote from the condenser unit, and spaced apart from the storage unit(s), for continuous delivery of ice nuggets to one or more storage units by a drive means other than gravity.

DETAILED DESCRIPTION OF THE PREFERRED EMBODIMENTS

Referring now to the drawing of FIG. 1 in detail, it will be seen that a building generally designated by the numeral 10 is shown, as having a ceiling 11, a floor 12, left and right end walls 13 and 14, a far wall 15, and with the near wall opposite the far wall 15, but not being shown in view of the sectional illustration of FIG. 1.

A second floor 16 is shown, divided into two rooms 17 and 18 by means of a separation wall 20.

Above the ground floor 12, is provided a room 21 comprised in the first floor.

It will be understood that the building 10 as described above is merely by way of example, in that any of myriad building layouts may advantageously be provided with ice making and delivery system equipment in accordance with this invention.

A condenser unit 22 is located on the roof 11 of the building 10.

The condenser unit 22 includes a cage 23, having air inlets 24 in a wall 25 thereof, and with air outlets 26 in an opposite wall thereof, for passage of air there-through in the direction of the arrows 28, 30, in response to operation of a rotating fan 31, suitably driven via a motor 32. The condenser 22 includes a condenser coil 33, which receives compressed gaseous fluids from a compressor 34, that, in turn, is driven by a motor 35 to compress gaseous fluids such as freon or the like. The condenser unit 22 is mounted on the roof 11 outside the building 10, to dissipate noise form the compressor 34 and dissipate heat from the condenser 33, without interfering with occupants of the building.

The condensed refrigerant is then delivered from the condenser 33, via a delivery line 36, through an expansion valve 37, wherein the high pressure gaseous fluid becomes a lower pressure liquid that circulates through the feed lines 38, 40 and/or 41, to feed one or more associated evaporators, 42, 43 and/or 44, respectively.

The evaporators 42, 43 and 44 are motor driven as at 45, whereby a single motor may drive all three evaporators. In the alternative individual motors could be used to drive each of the evaporators (not shown).

Inside each of the evaporators 42, 43 and 44, there is provide an associated ice making apparatus 46, 47 and 48, respectively.

Each of the evaporator/ice making apparatus may be constructed to be similar to those described in U.S. Pat. Nos. 5,394,708 and/or 6,134,908, the compete disclosures of which are herein incorporated by reference, or in accordance with the disclosures of other evaporator/nugget type ice making apparatus known in the art.

The evaporators 42, 43 and 44 surround respective auger type ice making apparatus 46, 47, 48, which, being rotatably driven, scrape ice that is being formed on interior walls 50, 51, 52 and the scraped ice is then driven by means of the augers toward an upper end of each ice making apparatus, whereby nuggets are formed and delivered to ice nugget conduits 53, 54, 55, such that the ice nuggets are integrally formed and driven by means of the motor 45 that rotates the augers 46, 47, 48, through the conduits 53, 54 and 55, to ice storage units 56 and 57.

The compressor 34 creates a reduced pressure in its refrigerant input line 58, whereby refrigerant is drawn through the evaporators 42, 43 and 44, completing the flow of refrigerant in a continuous cycle, as a closed refrigerant system.

It will be seen that ice nuggets 60 and 61 are thus delivered into the storage unit 56, via conduit ice nugget delivery lines 53, 54, at two different laterally spaced-apart locations within the storage unit 56, to facilitate a more even distribution of ice nuggets in the storage unit 56, than would be provided if nuggets were delivered to the storage unit 56 in a single, generally central location, whereby ice may form in a central generally conically-shaped pile (not shown).

The ice making apparatus 48 located inside the evaporator 44 provides ice nuggets via conduit 55, to the ice storage unit 57, which is shown as a counter-height dispenser unit.

It will be noted that both ice storage units 56 and 57 are adapted to continuously receive ice from the ice making apparatus, and that both storage units 56 and 57 are located at locations that are spaced apart from the ice making apparatus 46, 47 and 48. "Continuous" as used herein, will be understood to mean that the evaporators are continuously fed with refrigerant, and the ice making apparatus associated therewith are continuously fed with water, such that the augers inside the ice making apparatus can continuously scrape ice from being formed on cold walls thereof and continuously deliver the same through conduits to the ice storage units, as distinguished from making ice in batches and/or delivering ice in batches, as is the case with certain prior art equipment. It will be understood that, within the meaning of "continuous", the system of the present invention can be shut down periodically, for example, overnight when not in use, or at any other desired time. Also, within the understanding of continuous" herein, appropriate shut-off means may be provided, for shutting down the making and delivery of ice nuggets to the ice storage unit(s), as for example, if such storage unit(s) should become full, for example by shutting down the evaporator and/or the auger motor 45 or by opening any or all of switches 49, 49' and 49" as may be controlled by appropriate fullness sensors 59, 59' and 59", connected (by means not shown) to said switches and/or motor 45, for independent or simultaneous shutdown of said evaporators.

It will also be noted that the ice nugget conduit delivery lines 53, 54 and 55 need not be located immediately above the storage units 56, 57, and that the evaporator/ice making apparatus 42, 46;43, 47 and 44, 48 likewise need not be located above the storage units 56, 57, for gravity feed, but rather ice nuggets delivered via conduit lines 53, 54 and 55 are driven via forces generated by the ice making apparatus 46, 47, and 48 and the drive 45 therefor.

Thus, it will be seen that the ice making apparatus of this invention may be continually operative to deliver ice to storage units located some distance from the ice making apparatus, and also, if desired, at elevations located well above that of the ice making apparatus.

It will be noted that the condensing unit 22 in accordance with this invention is located outside a building 10, remote from the evaporator/ice making apparatus in accordance with this invention.

It will be apparent that in accordance with this invention various modifications may be made in the placement in the various components of this invention, in the use and operation thereof, in the use of pluralities of evaporator/ice making units, and in the use of pluralities of storage units, all within the spirit and scope of the invention as set forth in appended claims.

What is claimed is:

1. An ice making and delivery system comprising:

(a) a condenser unit including:

(i) a compressor for compressing a gaseous refrigerant;

(ii) a condenser for condensing the gaseous refrigerant and dissipating heat;

(b) the condenser unit being adapted for selective placement relative to a building such that compressor noise and condenser heat are substantially minimized relative to an evaporator zone in the building;

(c) at least one expansion valve for receiving a compressed gaseous fluid from the condenser and converting the gaseous fluid from a high temperature gaseous fluid to a lower temperature liquid fluid;

(d) at least one evaporator for receiving the lower temperature liquid fluid from the expansion valve and cooling an associated ice making apparatus;

(e) an ice making apparatus associated with said at least one evaporator and having means for creating ice on a cold wall of the apparatus and scraping ice from that wall and compressing the ice into formed nuggets;

(f) said at least one evaporator and its associated ice making apparatus being adapted to be separately located, spaced apart from the condenser unit, in an evaporator zone of the building;

(g) at least one ice storage unit being adapted to be separately located from the at least one evaporator and its associated ice making apparatus, and from the condenser unit, in an ice storage zone of the building;

(h) ice nugget conduit means connecting said ice making apparatus and the separately located ice storage unit;

(i) said ice nugget conduit means comprising means for delivery of ice nuggets from said ice making apparatus to said at least one ice storage unit; and (j) said ice making apparatus including ice nugget drive means for driving ice through said conduit means by a driving force other than gravity;

(k) means for returning refrigerant from the at least one evaporator, to the condenser unit; and (l) means for driving the compressor and ice making apparatus and its delivery means in a continuous manner, whereby ice nuggets are delivered to that at least one storage unit in a continuous manner;

wherein the at least one evaporators and their respective ice making apparatus are provided with two ice nugget conduit means; wherein the means of clause (h) comprise two means for delivery to two different laterally spaced apart locations in the same ice storage unit, for improving the distribution of ice nuggets in the storage unit.

2. An ice making and delivery system comprising:

(a) a condenser unit including:

(i) a compressor for compressing a gaseous refrigerant;

(ii) a condenser for condensing the gaseous refrigerant and dissipating heat;

(b) the condenser unit being adapted for selective placement relative to a building such that compressor noise and condenser heat are substantially minimized relative to an evaporator zone in the building;

(c) at least one expansion valve for receiving a compressed gaseous fluid from the condenser and converting the gaseous fluid from a high temperature gaseous fluid to a lower temperature liquid fluid;

(d) at least one evaporator for receiving the lower temperature liquid fluid from the expansion valve and cooling an associated ice making apparatus;

(e) an ice making apparatus associated with said evaporator and having means for creating ice on a cold wall of the apparatus and scraping ice from that wall and compressing the ice into formed nuggets;

(f) said at least one evaporator and its associated ice making apparatus being adapted to be separately located, spaced apart from the condenser unit, in an evaporator zone of the building;

(g) at least one ice storage unit being adapted to be separately located from the at least one evaporator and its associated ice making apparatus, and from the condenser unit, in an ice storage zone of the building;

(h) ice nugget conduit means connecting said ice making apparatus and the separately located ice storage unit;

(i) said ice nugget conduit means comprising means for delivery of ice nuggets from said ice making apparatus to said at least one ice storage unit; and (j) said ice making apparatus including ice nugget drive means for driving ice through said conduit means by a driving force other than gravity;

(k) means for returning refrigerant from the at least one evaporator, to the condenser unit; and (l) means for driving the compressor and ice making apparatus and its delivery means in a continuous manner, whereby ice nuggets are delivered to that at least one storage unit in a continuous manner;

wherein said evaporator and their respective ice making apparatus are provided with two ice nugget conduit means; wherein there are at least two different ice storage units and wherein the means of clause (h) comprise two means for delivery; each to a different ice storage unit.

3. The ice making and delivery system of claim 2, wherein the two different ice storage units are separately located relative to each other.

4. An ice making and delivery system for continuously making ice nuggets and delivering them to at least one storage unit, the system comprising:

(a) a refrigerant condenser unit including a compressor, a condenser and a means for dissipating heat from the condenser;

(b) at least one evaporator for continuously receiving refrigerant from the condenser unit and cooling a nugget type ice making apparatus;

(c) a nugget type ice making apparatus associated with said at least one evaporator, for continuously compressing ice formed on a surface thereof, into nuggets;

(d) conduit means for continuously delivering ice nuggets from ice making apparatus to at least one ice storage unit via a delivery force other than gravity;

(e) at least one ice storage unit for receiving and storing ice nuggets delivered from the ice making apparatus; and (f) said condenser unit, said at least one evaporator with its associated ice making apparatus and the at least one storage unit being adapted to be located spaced apart and remote from each other, wherein there are two said evaporators with their associated ice making apparatus, for delivery of ice via said conduit means, to at least one said ice storage unit; wherein there are two separate ice storage units, and wherein said conduit means comprise two means for delivering ice from said two ice making apparatus to said two ice storage units, each to a different ice storage unit.

* * * * *

UNITED STATES PATENT AND TRADEMARK OFFICE

CERTIFICATE OF CORRECTION

PATENT NO. : 6,952,935 B2
DATED : October 11, 2005
INVENTOR(S) : James Vorosmarti et al.

It is certified that error appears in the above-identified patent and that said Letters Patent is hereby corrected as shown below:

Title page,
Item [56], References Cited, U.S. PATENT DOCUMENTS, add the following items:

| | | | |
|---|---|---|---|
| -- 5,542,573 | 08/1996 | Frantz | 222/129.1 |
| 5,887,758 | 03/1999 | Hawkes, et al | 222/146.6 |
| 5,218,836 | 06/1993 | Jarosch | 62/227 |
| 4,276,751 | 07/1981 | Saltzman, et al | 62/138 |
| 3,371,508 | 03/1968 | A.J. Nelson | 431/17 |
| 3,126,719 | 03/1964 | M.J. Swatsick | 62/320 |
| 5,787,723 | 08/1998 | Mueller, et al | 62/347 |
| 6,540,067 | 04/2003 | Sellers, et al | 198/657 |
| 6,134,908 | 10/2000 | Brunner, et al | 62/354 |
| 5,394,708 | 03/1997 | Whinery, et al | 62/354 |
| 5,953,925 | 09/1999 | Mueller, et al | 62/73 |
| 6,134,907 | 10/2000 | Mueller, et al | 62/351 |
| 6,196,007 | 03/2001 | Schlosser et al | 62/73 --. |

Signed and Sealed this

Fourth Day of April, 2006

JON W. DUDAS
*Director of the United States Patent and Trademark Office*